US007299776B1

(12) United States Patent
Baker

(10) Patent No.: US 7,299,776 B1
(45) Date of Patent: Nov. 27, 2007

(54) VALVE ASSEMBLY FOR AN INTERNAL COMBUSTION ENGINE

(76) Inventor: W. Howard Baker, 103 Angela Dr., Bardstown, KY (US) 40004

( * ) Notice: Subject to any disclaimer, the term of this patent is extended or adjusted under 35 U.S.C. 154(b) by 0 days.

(21) Appl. No.: 11/539,712

(22) Filed: Oct. 9, 2006

Related U.S. Application Data

(60) Provisional application No. 60/596,661, filed on Oct. 11, 2005.

(51) Int. Cl.
*F01L 1/34* (2006.01)

(52) U.S. Cl. ..... 123/90.16; 123/90.24; 123/90.22; 123/90.23; 123/90.17

(58) Field of Classification Search ..... 123/90.16, 123/90.24, 90.22, 90.23
See application file for complete search history.

(56) References Cited

U.S. PATENT DOCUMENTS

| | | | |
|---|---|---|---|
| 82,276 | A | 9/1868 | Belleville |
| 1,231,302 | A | 6/1917 | Scott |
| 1,341,669 | A | 6/1920 | Porter |
| 2,534,123 | A | 12/1950 | Hasselhorn |
| 2,889,781 | A | 6/1959 | Thompson |
| 3,678,804 | A | 7/1972 | Heyl |
| 3,717,167 | A | 2/1973 | Allen |
| 3,768,776 | A | 10/1973 | Straslicka |
| 3,949,647 | A | 4/1976 | Martin |
| 4,151,979 | A | 5/1979 | Visalli |
| 4,154,424 | A | 5/1979 | Cherrie |
| 4,164,954 | A | 8/1979 | Ballard |
| 4,253,496 | A | 3/1981 | Wolf et al. |
| 4,256,020 | A | 3/1981 | Compton |
| 4,428,561 | A | 1/1984 | Thompson |
| 4,445,424 | A | 5/1984 | Foster et al. |
| 4,468,980 | A | 9/1984 | Johansen |
| 4,523,516 | A | 6/1985 | Foster et al. |
| 4,745,846 | A | 5/1988 | Eickmann |
| 4,779,512 | A | 10/1988 | Leonard |
| 4,813,338 | A | 3/1989 | Mortimer et al. |
| 4,871,143 | A | 10/1989 | Baker |
| 4,915,354 | A | 4/1990 | Sims, Jr. et al. |
| 5,097,595 | A | 3/1992 | Suggs |
| 5,183,209 | A | 2/1993 | Ricco et al. |
| 5,845,559 | A | 12/1998 | Schroeder et al. |
| 5,855,115 | A | 1/1999 | Martin |
| 6,086,345 | A | 7/2000 | Acharya et al. |
| 6,119,716 | A | 9/2000 | Wright |
| 6,142,749 | A | 11/2000 | Jack et al. |
| 6,257,845 | B1 | 7/2001 | Jack et al. |
| 6,439,177 | B2 * | 8/2002 | Pierik ..... 123/90.16 |
| 6,484,750 | B1 | 11/2002 | Foos et al. |
| 6,708,712 | B2 | 3/2004 | Wakeman |

* cited by examiner

*Primary Examiner*—Thomas Denion
*Assistant Examiner*—Kyle M. Riddle
(74) *Attorney, Agent, or Firm*—Stites & Harbison, PLLC; David W. Nagle, Jr.; William C. Ferrell, Jr.

(57) ABSTRACT

A valve assembly for an internal combustion engine includes: at least two valves supported by a pair of valve stem holders; a bracket; a closing actuator for pivoting and closing the valves upon contact with a closing lobe of a camshaft; one or more opening actuators for opening at least one of said valves upon contact with an opening lobe of the camshaft; and one or more Belleville spring washers, allowing for an adjustment of a sealing load when the respective valves are closed.

13 Claims, 4 Drawing Sheets

VALVE ASSEMBLY FOR AN INTERNAL COMBUSTION ENGINE

CROSS REFERENCES TO RELATED APPLICATIONS

This application claims priority to U.S. Provisional Application Ser. No. 60/596,661 filed on Oct. 11, 2005, the entire disclosure of which is incorporated herein by this reference.

BACKGROUND OF THE INVENTION

In an internal combustion engine, each valve is commonly actuated by a camshaft and spring. The camshaft compresses the spring in order to open the valve, while the action of the spring closes the valve. A spring, however, supplies a linear load, such that the more the spring is compressed, the greater the load on the camshaft. Thus, in order to maintain a sufficient load when the valve is closed and the spring is minimally compressed, stiff springs must be used. A stiff spring is also necessary to stop a valve as it reaches the most open part of its travel. If the spring was not stiff enough, the valve may "float," or stay open too long, and come in contact with the piston with disastrous results.

Of course, it takes significant force to compress a stiff spring. As such, camshafts have been known to twist or bend under the load. Thus, traditional valve systems require camshafts made of heavyweight, hardened steel. The added weight of the steel camshaft negatively affects the efficiency and performance of the engine. Furthermore, compressing the stiff springs and turning the camshaft requires a great deal of power, which also negatively affects the efficiency and performance of the engine.

The stiffness of the springs also negatively impacts the ability of each valve to remain sealed at high engine revolutions, because stiff springs tend to "bounce" when compressed or released quickly. Thus, the profile of the cam lobes on the camshaft must have a gradual slope. This greatly reduces the amount of time that the valve can stay fully open, which, in turn, reduces the amount of air and fuel that can be taken into the cylinder. This reduction in air and fuel in the cylinder also negatively affects the efficiency and performance of the engine.

Desmodromic valves attempt to solve some of the problems posed by traditional valve assemblies by eliminating the stiff springs, and instead using a camshaft and rockers to control both the opening and closing of each valve. The elimination of the stiff springs allows for a steeper cam lobe profile, which permits the valve to stay fully open longer and greatly improves the performance of the engine. However, desmodromic valves are typically very noisy. The noise results from the rockers transitioning from the opening cam lobe to the closing cam lobe. Furthermore, desmodromic valves produce excessive amounts of heat and wear from the mechanical interference between the rocker and cam lobes. Finally, desmodromic valves are also quite expensive to maintain, because the valves require frequent adjustment to account for wear. Therefore, desmodromic valves are primarily used in racing engines.

Thus, there remains a need in the art for an efficient valve assembly for an internal combustion engine that provides superior performance, but does not require frequent maintenance and/or adjustment.

SUMMARY OF THE INVENTION

The present invention is a valve assembly for an internal combustion engine. An exemplary valve assembly made in accordance with the present invention includes a support member for securing the valve assembly to the engine. A closing actuator is pivotally connected to the support member and includes a roller adapted for contacting a camshaft. A linkage is pivotally connected to the closing actuator, and in one exemplary embodiment, includes two arms. A pin passes through the arms of the linkage and the closing actuator to effectuate a pivotal connection between the linkage and the closing actuator. An orifice defined by a surface of the linkage receives a threaded end of a rod. The threaded end of the rod is held in place by two nuts, threaded onto the rod on opposite sides of the surface of the linkage. The rod extends from the linkage and terminates in a stop, with a Belleville spring washer stack interposed between the stop and a bracket.

The bracket in which the rod, stop, and Belleville washer stack connect is used to close both valve holders simultaneously. The two valve holders which each contains the lower cup, the cap, the pair of valve stem locks and a valve stem, which in operation close both valves simultaneously when the closing actuator is contacted by the closing lobe of the camshaft.

Additionally, two opening actuators are mounted on a shaft that extends through the support member. Each opening actuator includes a roller on an upper surface thereof for contacting a respective opening lobe of the camshaft, and further includes a roller at its distal end for contacting and applying a downward pressure to the valve stem holder. Specifically, in one exemplary embodiment, each pair of valve stem keepers is held within a cup having an open top and defining an orifice in a lower surface through which a valve stem extends. A lid is removably attached to each cup and covers the open top of the cup. The rollers at the distal ends of the respective opening actuators each contact and apply a downward pressure to the lids for opening the valves upon contact with the opening lobes of the camshaft.

Thus, as with common internal combustion engine designs, the exemplary valve assembly works with and is actuated by a camshaft. However, since no stiff springs are required, the camshaft can be made of aluminum or similar lightweight material. The camshaft is positioned such that as it rotates, a closing lobe of the camshaft contacts the roller extending from the lower surface of the closing actuator. Likewise, as the camshaft rotates further, opening lobes on the camshaft contact the respective rollers on the upper surfaces of the opening actuators. The lack of stiff springs in the system allows a steeper cam lobe profile as compared to common camshaft constructions, which allows the valve to stay fully open longer, thus greatly improving the performance of the engine.

Furthermore, the use of a Belleville spring washer stack interposed between the stop and a bracket allows for an adjustment of a sealing load when the respective valves are closed and the bracket allows for balancing of the sealing load between the two valves.

DETAILED DESCRIPTION OF THE INVENTION

The present invention is a valve assembly for an internal combustion engine.

Figure 1:
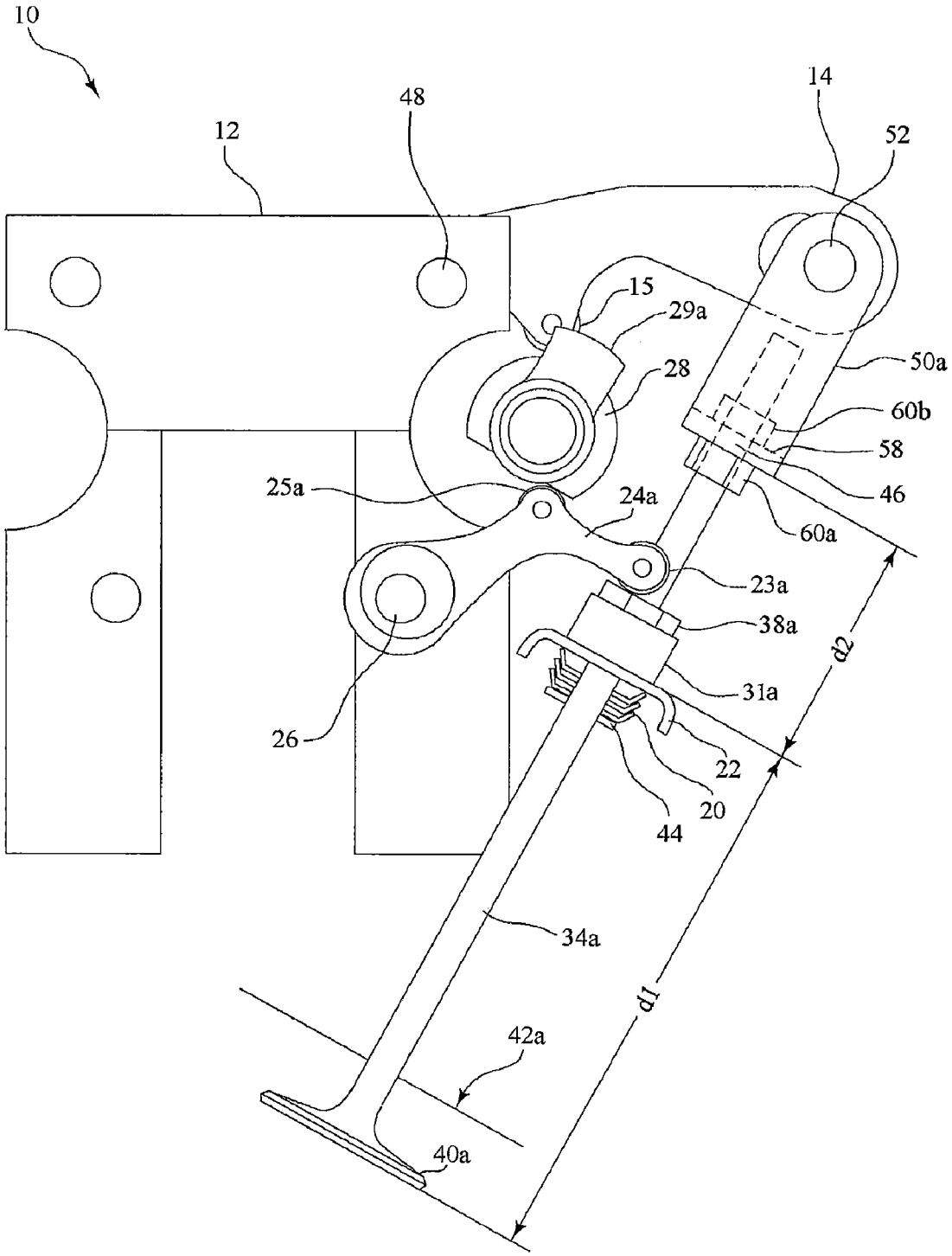
FIG. 1 is a side view of an exemplary valve assembly for an internal combustion engine made in accordance with the present invention.
Figure 2:
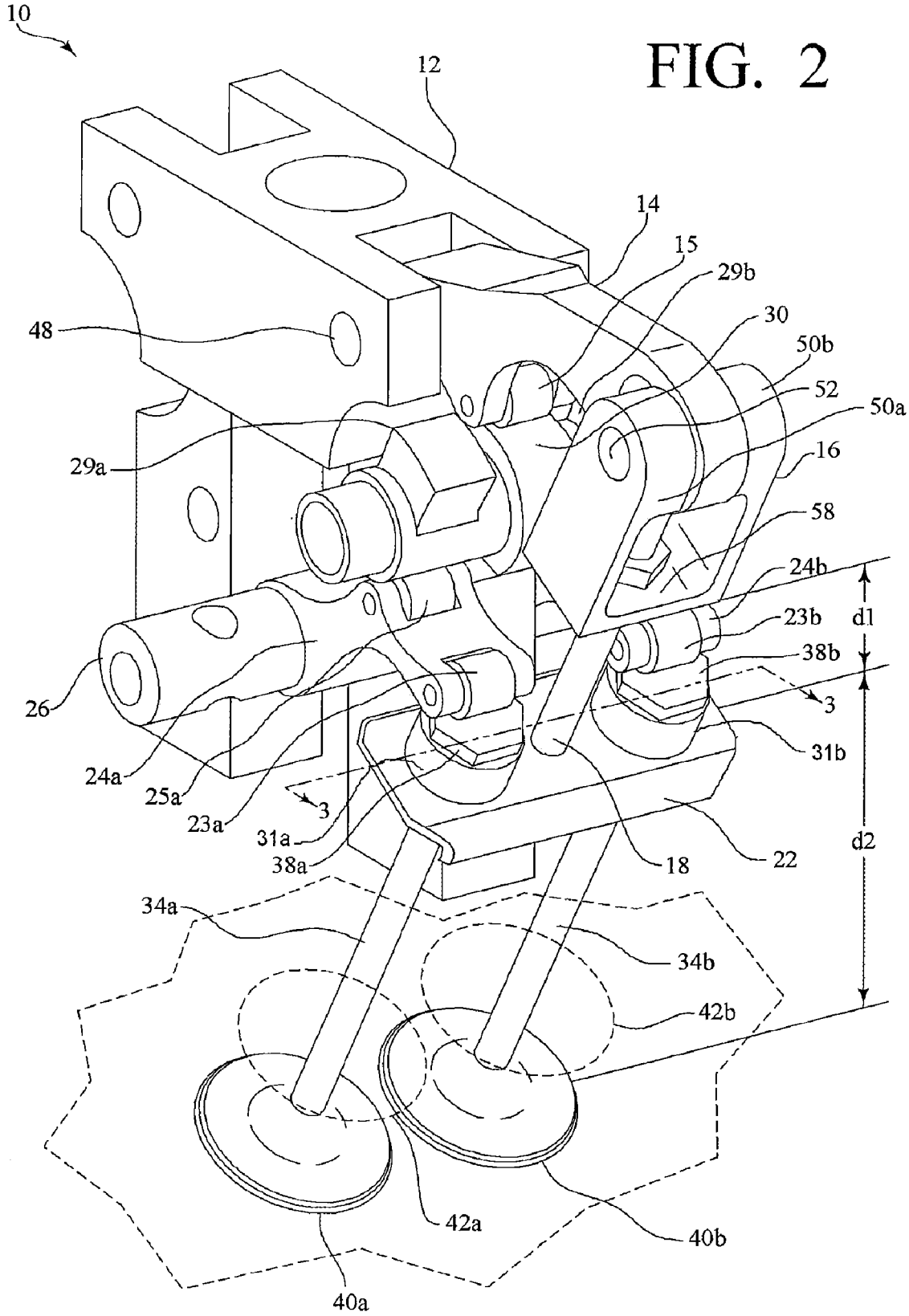
FIG. 2 is a perspective view of the exemplary valve assembly of FIG. 1.

FIGS. 1 and 2 are respective side and perspective views of an exemplary valve assembly 10 for an internal combustion engine made in accordance with the present invention, including a support member 12 for securing the valve assembly 10 to an engine (not shown). Of course, this support member 12 may be integral with the head casting in an OEM (original equipment manufacturer) application. A closing actuator 14 is pivotally connected to the support member 12 by a pin 48. Of course, other means of pivotally connecting the closing actuator 14 to the support member 12 would be acceptable (for instance, an encapsulated ball, a clevis, a spherical bearing, or a ball joint) without departing from the spirit and scope of the present invention. The closing actuator 14 further includes a roller 15 extending from and mounted for rotation with respect to a lower surface of the closing actuator 14, which is adapted for contacting a camshaft, as will be described in greater detail below. In this exemplary embodiment, the roller 15 is made of an impact and wear resistant material, such as hardened S-7 steel.

Referring still to FIGS. 1 and 2, a linkage 16 is pivotally connected to the closing actuator 14. In this exemplary embodiment, the linkage 16 includes two arms 50*a*, 50*b*. A pin 52 passes through the arms 50*a*, 50*b* of the linkage 16 and the closing actuator 14 to effectuate a pivotal connection between the linkage 16 and the closing actuator 14. A surface 58 of the linkage 16 extending between the respective distal ends of the arms 50*a*, 50*b* defines an orifice 46 which receives a threaded end of a rod 18. The threaded end of the rod 18 is held in place by two nuts 60*a*, 60*b*, threaded onto the rod 18 on opposite sides of the surface 58 of the linkage 16 extending between each arm 50*a*, 50*b*. The rod 18 extends from the linkage 16 and terminates in a stop 44, with one or more Belleville washers 20 interposed between the stop 44 and a bracket 22. The function of the Belleville spring washers 20 is discussed in further detail below.

Referring still to FIGS. 1 and 2, two opening actuators 24*a*, 24*b* are mounted on a shaft 26 that extends through the support member 12. Each opening actuator 24*a*, 24*b* includes a roller 23*a*, 23*b* at its distal end for contacting and applying a downward pressure to a valve stem holder 31*a*, 31*b* as will be further described below. Each opening actuator 24*a*, 24*b* also includes a roller 25*a*, 25*b* on an upper surface thereof for contacting a respective opening lobe 29*a*, 29*b* of the camshaft 28, as will also be further described below. In this exemplary embodiment, the rollers 23*a*, 23*b*, 25*a*, 25*b* are all made of an impact and wear resistant material, such as 4140 or hardened S-7 steel.

As with common internal combustion engine designs, the valve assembly 10 of the present invention works with and is actuated by a camshaft 28. Since no stiff springs are required, the camshaft 28 can be made of aluminum or similar lightweight material, as opposed to a heavyweight, hardened steel. Of course, any material of sufficient strength, including steel, titanium, or a composite material, could also be used without departing from the spirit and scope of the present invention. The camshaft 28 is positioned such that as it rotates, a closing lobe 30 of the camshaft 28 contacts the roller 15 extending from the lower surface of the closing actuator 14. Likewise, as the camshaft 28 rotates further, two opening lobes 29*a*, 29*b* on the camshaft 28 contact the respective rollers 25*a*, 25*b* on the upper surfaces of the opening actuators 24*a*, 24*b*. The lack of stiff springs in the system allows a steeper cam lobe profile as compared to common camshaft constructions, which allows the valve to stay fully open longer, thus greatly improving the performance of the engine.

Figure 3:
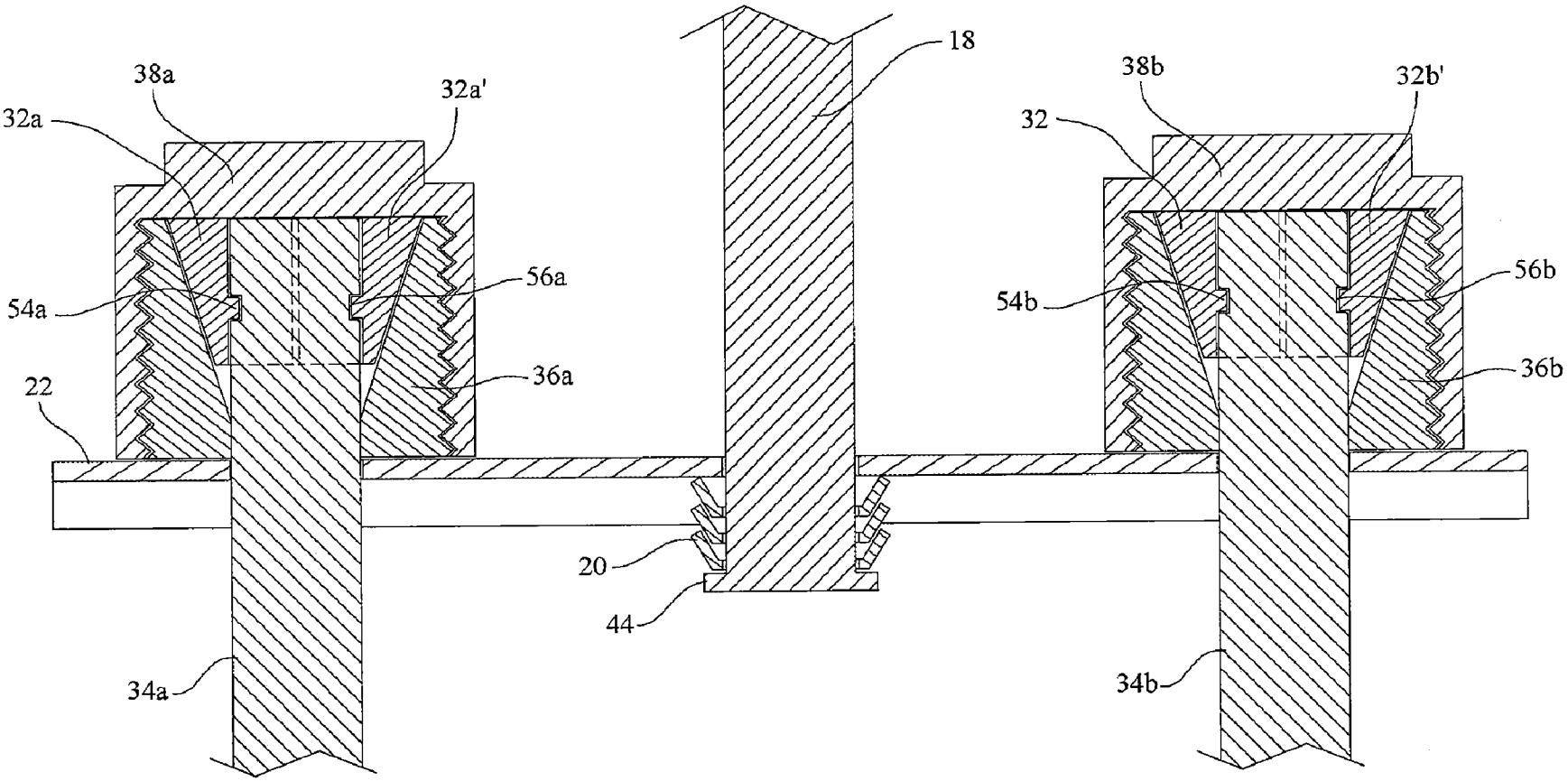
FIG. 3 is an enlarged sectional view of the valve stem holder assemblies along with the bracket, rod with stop, and Belleville washer assembly.

Referring generally to FIGS. 1 and 2 and specifically to FIG. 3, a valve stem holder 31 includes the bracket 22 described above (which is operably connected to the linkage 16 and the closing actuator 14 by the rod 18), along with two pairs of valve stem keepers 32*a*, 32*b*, each retaining an end of a respective valve stem 34*a*, 34*b*. In other words, the bracket 22 supports two valve stem holders 31*a*, 31*b* which support the two valve stems 34*a*, 34*b*, through the two pairs of valve stem keepers 32*a*, 32*b*, the bracket closes both valves simultaneously when the closing actuator 14 is activated by the closing cam lobe 30 of the camshaft 28. Each pair of valve stem keepers 32*a*, 32*b* is held within a cup 36*a*, 36*b* having an open top and defining an orifice in a lower surface through which a valve stem 34*a*, 34*b* extends. A lid 38*a*, 38*b* is removably attached to each cup 36*a*, 36*b* and covers the open top of the cup 36*a*, 36*b*. The heat associated with the engine may cause the valve stems 34*a*, 34*b* to stretch in use. Even though the valve stems 34*a*, 34*b* are made of the same material, they may wear unevenly. The use of a single rod 18 and closing actuator 14 for controlling two valve stems 34*a*, 34*b* allows the system to balance itself in the event that one valve stem 34*a*, 34*b* wears differently than the other.

Referring still to FIG. 3, each pair of valve stem keepers 32*a*, 32*a*', 32*b*, 32*b*' in the exemplary valve assembly 10 is of a type commonly used to hold valve stems. Specifically, each pair of valve stem keepers 32*a*, 32*a*', 32*b*, 32*b*' comprises an externally tapered outer surface, with a half-round boss 54*a*, 54*b* arranged circumferentially around an internal surface of the two halves of each pair of valve stem keepers 32*a*, 32*a*', 32*b*, 32*b*'. The boss 54*a*, 54*b* is designed to interlock with a circumferential channel 56*a*, 56*b* defined by the valve stem 34*a*, 34*b*.

The cup 36*a*, 36*b* is externally threaded and internally tapered so that each pair of valve stem keepers 32*a*, 32*a*', 32*b*, 32*b*' protrudes slightly above the cup 36*a*, 36*b* when the lid 38*a*, 38*b* is not in place. The lid 38*a*, 38*b* is internally threaded to receive the threads of the cup 36*a*, 36*b*. The cup 36*a*, 36*b* and the lid 38*a*, 38*b* are externally partially hexagon-shaped to allow tightening of the two together. Because each pair of valve stem keepers 32*a*, 32*a*', 32*b*, 32*b*' protrudes above the associated cup 36*a*, 36*b* and is tapered, a radial pressure is applied to the valve stem 34*a*, 34*b* when the lid 38*a*, 38*b* is tightened to the cup 36*a*, 36*b*. The radial pressure allows the boss 54*a*, 54*b* on each pair of valve stem keepers 32*a*, 32*a*', 32*b*, 32*b*' to positively seat in the channel 56*a*, 56*b* defined by the respective valve stem 34*a*, 34*b*. The rollers 23*a*, 23*b* at the distal ends of the respective opening actuators 24*a*, 24*b* each contact and apply a downward pressure to the lid 38*a*, 38*b* of the valve stem holder 31*a*, 31*b*. However, the rollers 23*a*, 23*b* may contact other portions of the valve stem holder 31*a*, 31*b* without departing from the spirit and scope of the present invention.

Figure 4:
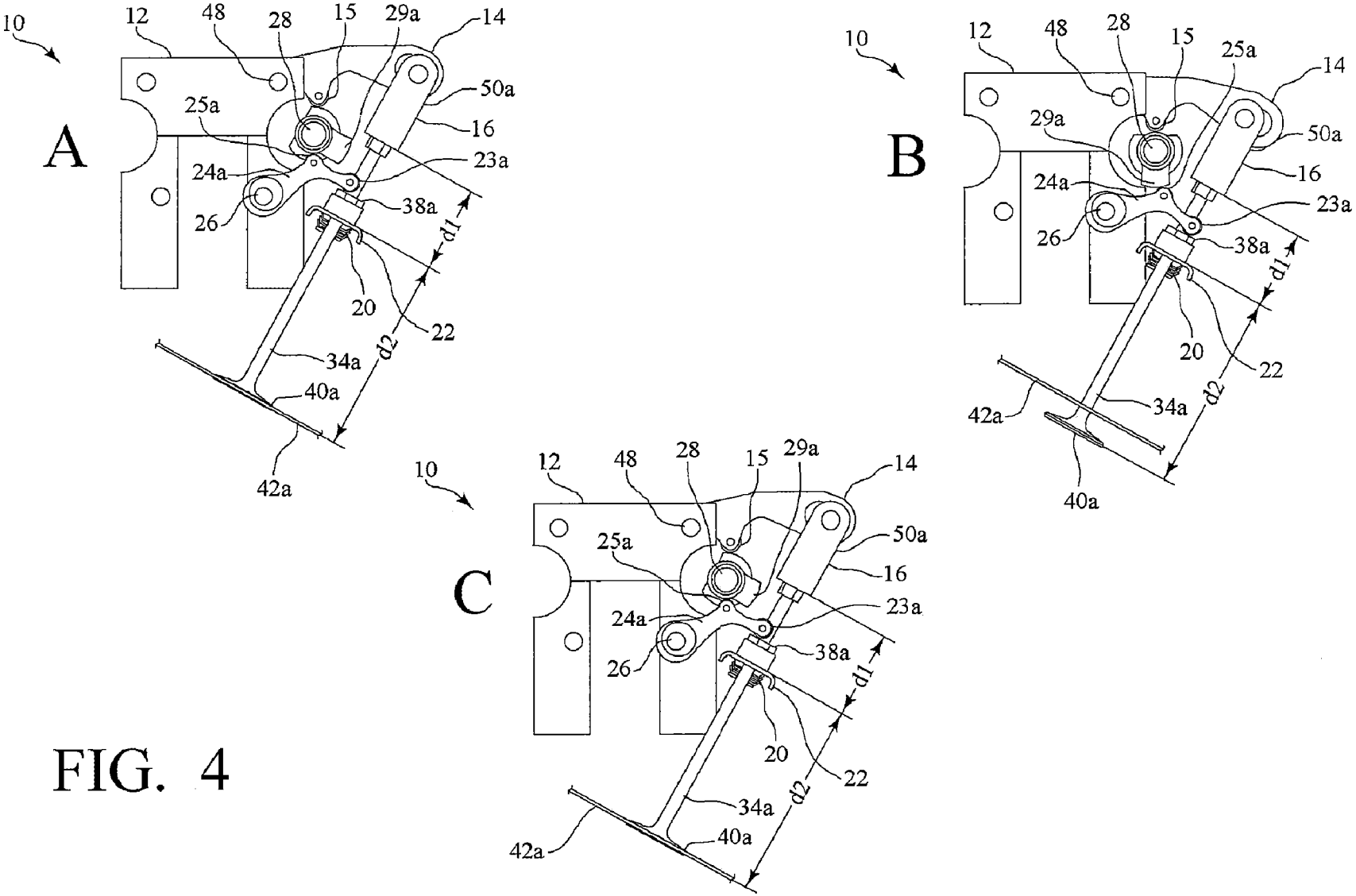
FIGS. 4*a*-4*c* are schematic views of the exemplary valve assembly of FIG. 1, illustrating the operation of the valve assembly.

Referring now to FIGS. 4*a*-4*c*, as the camshaft 28 rotates, it pivots the opening actuator 24*a* and closing actuator 14, which, in turn, activates the rest of the opening and closing movements. Thus, the diameter and placement of the opening lobes 29*a*, 29*b* and closing lobe 30 determine the duration of the intake and exhaust cycles and the amount of air/fuel mixture allowed into and out of the engine.

More specifically, as shown in FIGS. 4*a* and 4*b*, as the camshaft 28 rotates, the opening lobe 29*a* on the camshaft 28 contacts the roller 25*a* on the opening actuator 24*a*, causing the opening actuator 24*a* to pivot clockwise about the shaft 26 so that it applies a downward pressure on the lid 38*a* of the valve stem holder 31. As the opening actuator 24*a* pivots, a distal end of the opening actuator 24*a* lowers, causing the valve stem 34*a* to lower, thus opening the valve for an air/fuel mixture to enter the cylinder (not shown). In the exemplary embodiment, the lid 38*a* of the valve stem holder 31 is made of a material such that the lid 38*a* interacts with the roller 23*a* on the opening actuators 24*a* with minimal wear. This may also be accomplished with an insert, coating, or other surface treatment of the upper surface of the lid 38*a*.

Referring now to FIGS. 4*b* and 4*c*, as the camshaft 28 rotates further, the closing lobe 30 of the camshaft 28 contacts the roller 15 on the closing actuator 14, causing the closing actuator 14 to pivot counterclockwise about the pin 48 and raising the distal end of the closing actuator 14. This action pulls the linkage 16, rod 18, the bracket 22, valve stem holder 31, and valve stem 34*a* upwardly until a face 40*a* of the valve contacts a seat 42*a* of the engine head, thus closing the valve. Of course, contact of the face 40*a* of the valve with the seat 42*a* of the engine head prevents further upward movement of the valve stem 34*a*, and thus any continuing pulling action results in movement of the rod 18 with respect to the bracket 22, and thus, a further compression of the Belleville spring washers 20.

Since the rod 18 is held in place by two nuts 60*a*, 60*b*, threaded onto the rod 18 on opposite sides of the surface 58 of the linkage 16, by repositioning the nuts 60*a*, 60*b*, the distance, d1, between the linkage 16 and the bracket 22 can be adjusted. By shortening the distance, d1, when the valves are pulled closed, the Bellville spring washers 20 will be further compressed, thus increasing the sealing load on the valve stem 34*a*. Thus, adjustment of the relative position of the rod 18 allows for adjustment of the sealing load placed on the valve stem 34*a* when the valve is closed.

The sealing load can be also adjusted by the strength of the Belleville spring washers 20, their number, or the way in which they are stacked. By stacking the Belleville spring washers 20 in parallel instead of in series, their pressure will be added together; thus, two Belleville spring washers stacked in parallel will have twice the load of the same two Belleville spring washers stacked in series. Also, the height of the Belleville spring washer stack 20 will determine how much deviation in the distance, d2, from the valve seat 42*a* to the bracket 22 is allowable. Thus, by varying the number of Belleville spring washers in the stack 20, almost any length deviation between the valve seat 42*a* and the valve stem channel 56*a* and sealing load can be accomplished. The Belleville spring washers 20 also facilitate and smooth the transition of the valve between an open position and a closed position, thus reducing noise.

Although the foregoing discussion of FIGS. 4*a*-4*c* describes the parts related to one valve stem 34*a*, there is an identical assembly of parts related to the second valve stem 34*b*, which is not shown in FIGS. 4*a*-4*c*, but can be seen in FIG. 2. Of course, there is also a complete assembly for the exhaust side of the cylinder.

One of ordinary skill in the art will recognize that additional embodiments are also possible without departing from the teachings of the present invention or the scope of the claims that follow. This detailed description, and particularly the specific details of the exemplary embodiment disclosed, is given primarily for clarity of understanding, and no unnecessary limitations are to be understood therefrom, for modifications will become obvious to those skilled in the art upon reading this disclosure and may be made without departing from the spirit or scope of the claimed invention.

What is claimed is:

1. A valve assembly for an internal combustion engine, comprising:

a support member for securing the valve assembly to the engine;

two or more valves, each valve including a valve stem;

a closing actuator pivotally connected to the support member and operably connected to said valves, said closing actuator adapted to pivot and close said valves upon contact with a closing lobe of a camshaft for closing;

two or more opening actuators mounted on a shaft that extends through said support member and operably connected to said valves, each opening actuator adapted to open at least one of said valves upon contact with an opening lobe of the camshaft;

a linkage connected to the closing actuator;

a valve stem holder for supporting valve stems of said valves;

a bracket to support two or more valve stem holders;

a rod secured to and extending from said linkage, passing through the bracket of the valve stem holder and terminating in a stop; and one or more Belleville spring washers interposed between said stop and said bracket, said Belleville spring washers allowing for an adjustment of a sealing load on said valve stems when the respective valves are closed and further facilitating a transition of said valves between an open position and a closed position.

2. The valve assembly as recited in claim 1, wherein said linkage includes two arms.

3. The valve assembly as recited in claim 2, wherein a pin passes through the arms of said linkage and said closing actuator to effectuate a pivotal connection between said linkage and said closing actuator.

4. The valve assembly as recited in claim 3, wherein said linkage includes a surface that defines an orifice for receiving a threaded end of said rod.

5. The valve assembly as recited in claim 4, wherein the threaded end of said rod is held in place by two nuts threaded onto the rod on opposite sides of said linkage.

6. The valve assembly of claim 1, wherein two or more Belleville washers are arranged in series.

7. The valve assembly of claim 1, wherein two or more Belleville washers are arranged in parallel.

8. The valve assembly as recited in claim 1, in which the relative positioning of said rod with respect to said linkage and said bracket can be adjusted such that a distance between said linkage and said bracket is lengthened or shortened, the shortening of the distance between said linkage and said bracket resulting in an increased sealing load on said valve stems when the respective valves are closed.

9. The valve assembly as recited in claim 1, in which said closing actuator operates to close said valves simultaneously by pulling said linkage, said rod, said bracket, and said valve stem holder upwardly when said closing actuator is contacted by the closing lobe of the camshaft.

10. The valve assembly as recited in claim 1, wherein said valve stem holder further includes:

a pair of valve stem keepers attached to each valve stem of said valves;

a cup for receiving each pair of valve stem keepers, said cup having an open top and defining an orifice in a lower surface through which the respective valve stem extends; and a lid removably attached to each cup and covering the open top of the cup.

11. The valve assembly as recited in claim 10, wherein each pair of valve stem keepers includes an externally tapered outer surface, with a half-round boss arranged circumferentially around an internal surface of each pair of valve stem keepers for interlocking with a circumferential channel defined by a respective valve stem.

12. The valve assembly as recited in claim 10, wherein the cup associated with each pair of valve stem keepers is externally threaded with the lid being provided with corresponding internal threads, so that the cup and the lid can be mated and attached to one another.

13. The valve assembly as recited in claim 10, wherein each said opening actuator opens one of said valves by contacting and applying a downward pressure to the lid of the respective valve stem keeper.

* * * * *